United States Patent [19]

Lincke

[11] Patent Number: 4,491,158

[45] Date of Patent: Jan. 1, 1985

[54] GRIPPER CLAMP PROJECTILE

[75] Inventor: Paul Lincke, Zell, Switzerland

[73] Assignee: Sulzer Brothers Limited, Winterthur, Switzerland

[21] Appl. No.: 482,207

[22] Filed: Apr. 5, 1983

[30] Foreign Application Priority Data

Apr. 7, 1982 [CH] Switzerland ..... 2146/82

[51] Int. Cl.[3] ..... D03D 47/24

[52] U.S. Cl. ..... 139/439; 139/196.2

[58] Field of Search ..... 139/196.2, 196.3, 429, 139/437, 438, 439, 453

[56] References Cited

U.S. PATENT DOCUMENTS 3,472,286 10/1969 Schneider ..... 139/196.2

FOREIGN PATENT DOCUMENTS 183135 11/1966 U.S.S.R. ..... 139/435

*Primary Examiner*—Henry S. Jaudon

*Attorney, Agent, or Firm*—Kenyon & Kenyon

[57] ABSTRACT

The gripper projectile has a yarn clamp with clamping jaws which, when opened to receive a weft yarn, bound a flow duct. The duct is disposed in communication with air exit orifices in the casing of the projectile so that air which is injected by a yarn supplying device and entraining the weft yarn end flows through the duct without turbulance. The clamping jaws may be provided with recesses for ducts to further center the delivered weft yarn. In other embodiments, inserts may be provided within the projectile casing to form nozzles for the flow of air to the exit orifices.

18 Claims, 16 Drawing Figures

Fig. 2
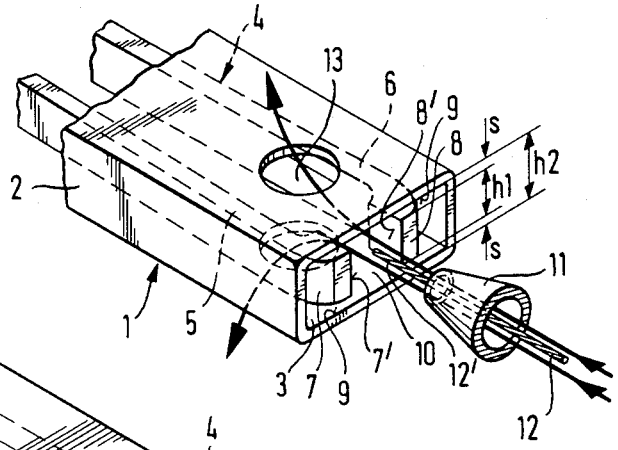
Fig. 1
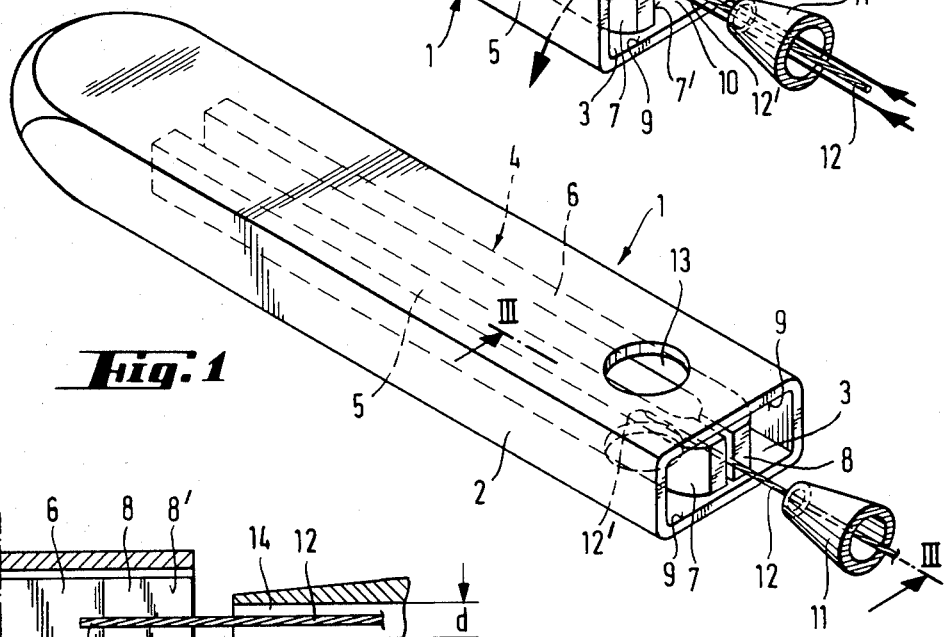
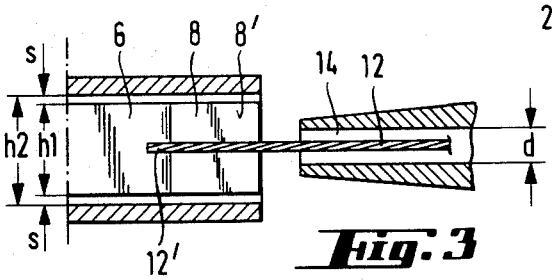
Fig. 3
Fig. 4a
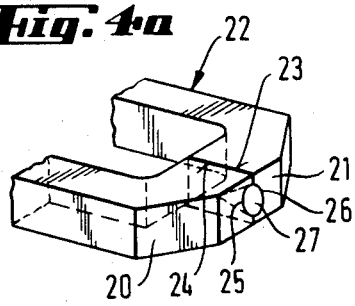
Fig. 4b
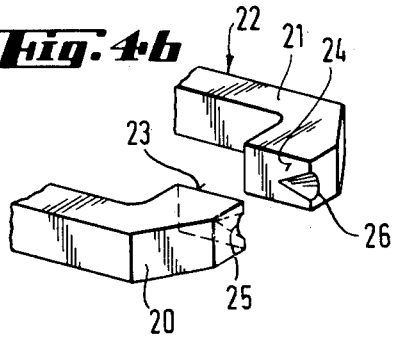

Fig. 5
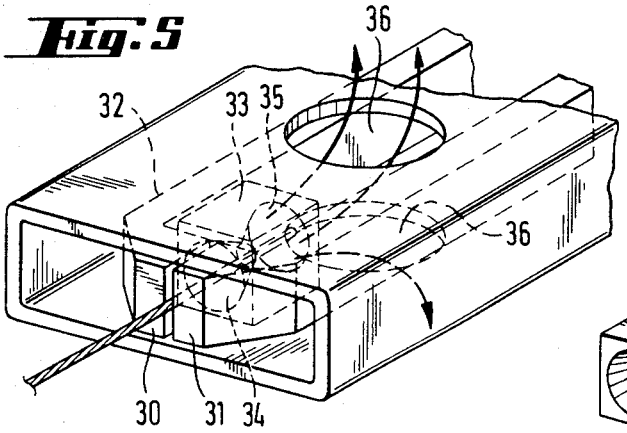
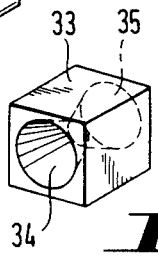
Fig. 6
Fig. 7
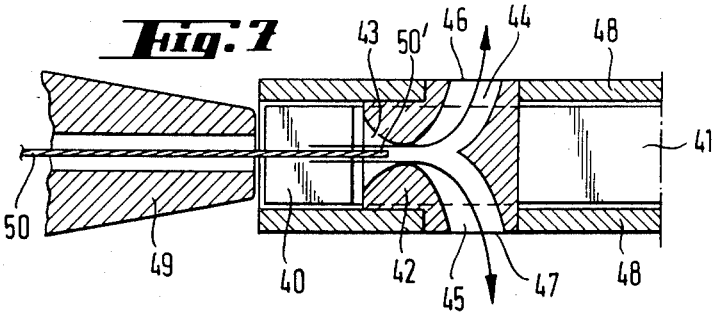
Fig. 8
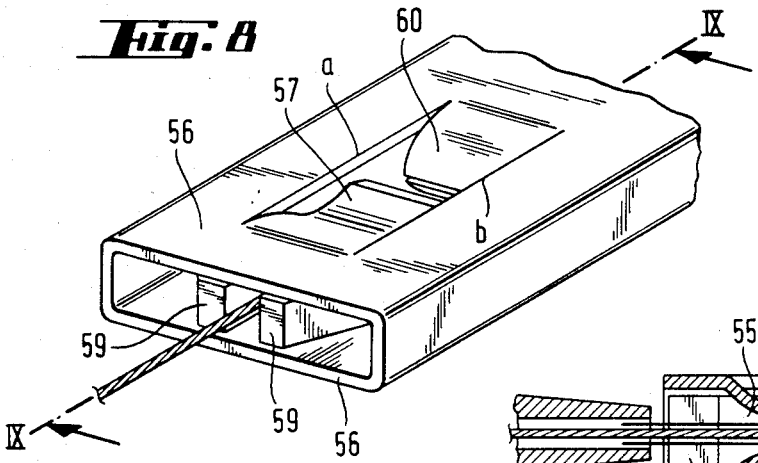
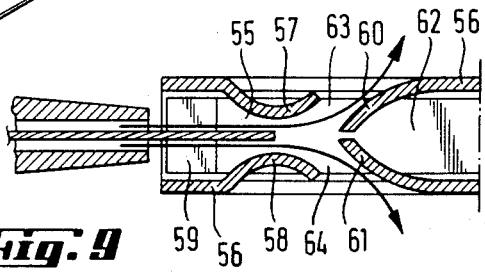
Fig. 9

GRIPPER CLAMP PROJECTILE

This invention relates to a gripper clamp projectile. More particularly, this invention relates to a gripper clamp projectile for a weaving machine.

As is known, various types of gripper clamp projectiles have been used in weaving machines. In many cases, the projectiles have been constructed of a casing within which a pair of arms are mounted in spring biased fashion and with clamping jaws at the ends in order to grip a weft yarn to be inserted within a shed of warp yarns. Generally, the yarn is supplied to the gripper projectile by means of a mechanically operated yarn clamp. Mechanical clamps, however, have various disadvantages. Particularly, the parts involved in the clamping of the yarn are subject to heavy wear, so that they need be lubricated. This, however, renders the fluff present oily causing dirty spots in the cloth when getting thereinto. In order to overcome these disadvantages, pneumatically operating yarn supply devices have been introduced in the past. It is known, however, that the air entering the gripper projectile from such a yarn supply device requires an outlet in order to prevent turbulence from occuring within the projectile, which may interferere with a reliable gripping and subsequent clamping of the weft yarn end by the clamping yaws.

In order to provide for the exhaust of the weft yarn entraining air, projectiles have been provided with openings for the escape of the air. However, even with the openings in the projectile casing, some difficulties remain in having the weft yarns inserted in a smooth manner.

Accordingly, it is an object of the invention to provide a gripper clamp projectile which is able to receive a weft yarn end in a trouble-free manner. It is another object of the invention to provie a controlled flow path for a flow of air entraining a weft yarn into a gripper clamp projectile.

It is another object of the invention to provide a gripper clamp projectile which is adapted to cooperate with a pneumatic weft yarn supplying device.

Briefly, the invention provides a gripper clamp projectile for a weaving machine which is comprised of a casing having walls with at least one air exhaust orifice in at least one wall and a yarn clamp having a pair of clamping jaws disposed in the casing for movement between a closed position to clamp a weft yarn therebetween and an open position with the clamping jaws spaced from each other and defining an air flow duct with the casing walls which is in communication with the orifice in order to conduct a flow of air therethrough.

In one embodiment, each clamping jaw is further provided with a recess at a forward end which faces the other jaw in order to define a conical centering aperture with the opposed recess when the jaws are in the closed position. This serves to further center the incoming weft yarn.

In another embodiment, the gripper projectile clamp is provided with an insert within the casing in the form of a nozzle in order to further communicate the formed duct with the orifice in the casing wall. In this regard, the nozzle may be formed with one exit duct for the air or with a pair of exit ducts. In this latter case, each exit duct may communicate directly with an orifice in a casing wall.

In still another embodiment, the casing walls may be deformed to define a nozzle behind the clamping jaws. In addition, the casing walls are provided with a pair of inwardly deformed lips which are disposed in opposed relation downstream of the nozzle in order to bound a pair of opposed orifices for the exiting air.

In addition to the above embodiments for guiding the air through the projectile, at least one of the jaws may be provided with a centering duct for the passage of a weft yarn. In the case where only one jaw is provided with a centering duct, the jaws are stepped so as to be disposed in overlapping relation. In the case where each jaw has a centering duct, for example for the insertion of two weft yarns into a shed, each duct has an outlet facing the opposite jaw.

The gripper projectile may also be provided with a centering insert where the projectile cooperates with a weft insertion device for multiple weft yarns. In this case, the centering insert has a weft yarn entry chamber which extends in funnel-fashion towards the clamping jaws and with an exit orifice disposed centrally of the jaws.

Where the projectile is used with a weft insertion device having a duct for conveying a weft yarn, the clamping jaws of the projectile are formed with clamping surfaces of a height at least twice the diameter of the duct in the insertion device.

These and other objects and advantages of the invention will become more apparent from the following detailed description taken in conjunction with the accompanying drawings wherein:

FIG. 1 illustrates a perspective view of a gripper clamp projectile constructed in accordance with the invention;

FIG. 2 illustrates a forward part of the projectile of FIG. 1 with the clamping jaws in an open position;

FIG. 3 illustrates a detailed cross-sectional view of the clamping jaws and a weft insertion device in accordance with the inention;

FIG. 4*a* illustrates a part perspective view of a pair of modified clamping jaws in accordance with the invention in a closed position;

FIG. 4*b* illustrates a view similar to FIG. 4*a* of the clamping jaws thereof in an open position;

FIG. 5 illustrates a part perspective view of a modified projectile having an insert in accordance with the invention;

FIG. 6 illustrates a perspective view of the insert of FIG. 5;

FIG. 7 illustrates a cross-sectional view of a modified insert in a projectile in accordance with the invention;

FIG. 8 illustrates a part perspective view of a further modified gripper projectile having an integrally formed nozzle in the accordance with the invention;

FIG. 9 illustrates a view taken on line IX—IX of FIG. 8.

Figure 10:
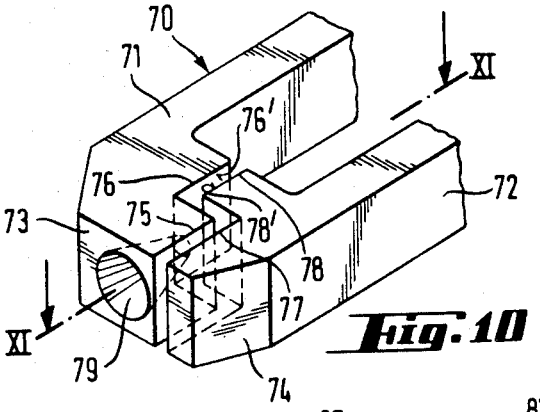
Figure 11:
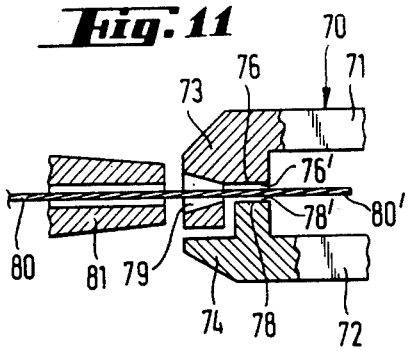
Figure 12:
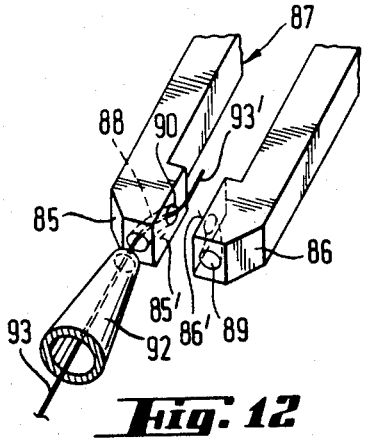
Figure 13:
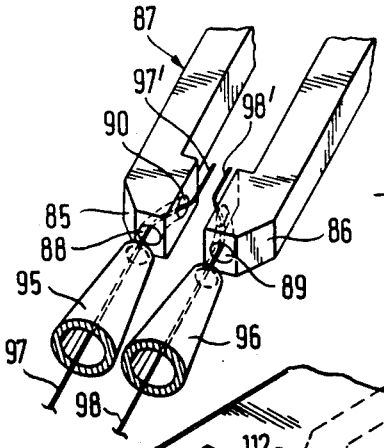
Figure 14:
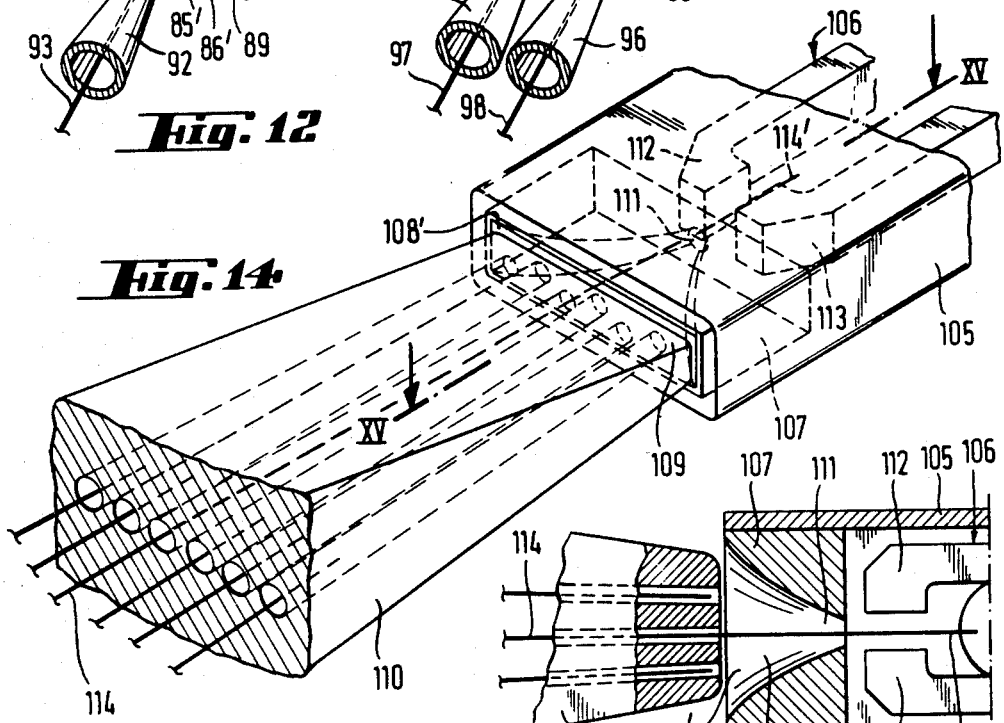
Figure 15:
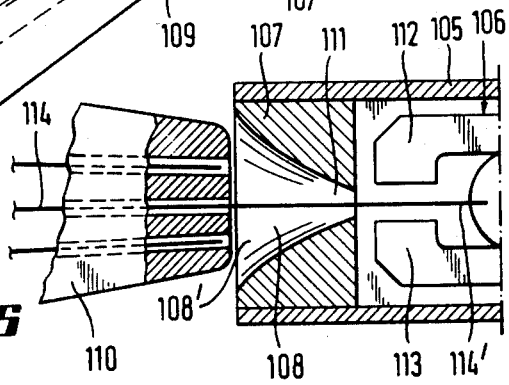

FIG. 10 illustrates a fragmentary view of a pair of clamping jaws of stepped construction in accordance with the invention;

FIG. 11 illustrates a part cross-sectional view of FIG. 10 in association with a weft insertion device;

FIG. 12 illustrates a part perspective view of a pair of modified clamping jaws having centering ducts therein in accordance with the invention;

FIG. 13 illustrates a view similar to FIG. 12 of the clamping jaws in cooperation with a pair of weft insertion devices;

FIG. 14 illustrates a part perspective view of a modified gripper clamp projectile in accordance with the invention in cooperation with a multiweft insertion device; and FIG. 15 illustrates a view taken on line XV—XV of FIG. 14.

Referring to FIGS. 1 and 2, the gripper clamp projectile 1 has a casing 2 which is formed in known manner to define a plenum chamber (hollow exterior) 3. As indicated, the casing 2 is formed with a pair of opposed flat walls 9 each of which is provided with an orifice 13. In addition, the projectile 1 has a weft yarn clamp 4 disposed within a casing 2. This clamp 4 has a pair of axially extending arms 5, 6 each of which has a clamping jaw 7, 8 at one end. As is known, the arms 5, 6 are movable between a closed position with the clamping jaws 7, 8 in engagement and an open position with the clamping jaws spaced from each other (see FIG. 2).

As shown in FIG. 3, the height h1 of the clamping jaws 7, 8 is only slightly less than the height h2 of the interior 3 so that there is only a very reduced clearance s between the jaws 7, 8 and the walls 9.

The yarn clamp 4 is opened in known manner by the introduction of a clamp opener (not shown) into the projectile 1 for pressing of the arms 5, 6 apart from each other. To this end the walls 9 of the projectile 1 are provided with an opening (not shown) to pass the clamp opener. When the yarn clamp is so opened, the jaws 7, 8 cooperate with the two casing walls 9 in order to define a substantially closed flow duct 10. This duct 10 is in communication with both orifices 13 in order to conduct a flow of air therethrough. That is, the flow duct 10 is situated so that air which is blown into the projectile casing 2 by a weft yarn insertion device 11 with an entrained weft yarn end 12 is able to move through the duct 10 without turbulance while the weft yarn end 12' is supplied in a substantially stretched condition between the jaws 7, 8. When the clamp opener (not shown) thereafter disengages and the clamp 4 closes, the weft yarn end 12' is reliably clamped between the clamping jaws 7, 8 and, particularly, the clamping surfaces 7', 8' on the jaws 7, 8. As indicated in FIG. 2, the air discharging from the duct 10 leaves the projectile 1 through the orifices 13 on both sides of the casing 2.

Referring to FIG. 3, where the weft insertion device has a duct 14 with a diameter d for the conveyance of the weft yarn 12, the height h1 of the jaw 7, 8 is at least twice the diameter d of the duct 14. When this dimensional relationship is used, the air flow through the duct 10 is substantially laminar so that the weft yarn end 12' enters the duct 10 substantially rectilinearly.

Referring to FIGS. 4*a* and 4*b*, a yarn clamp 22 (shown partially) may be formed with clamping jaws 20, 21 which have clamping surfaces 23, 24 provided with a recess 25, 26 facing the other jaw in order to define a conical centering aperture 27 with the opposite recess when the jaws 20, 21 are in the closed position. (FIG. 4*a*). This aperture 27 further facilitates entry of especially fine yarns end into the flow duct defined between the jaws 20, 21.

Referring to FIGS. 5 and 6, a projectile may also be provided with an insert in the form of a nozzle 33 behind the clamping jaws 30, 31 of a yarn clamp 32. As indicated, the nozzle 33 is secured to the lower wall of the casing and is provided with an entry duct 34 in alignment with the clamping jaws 30, 31 as well as with an exit duct 35 which terminates before the exit orifices 36 in the casing of the projectile. In this embodiment, the flow duct for the entraining air extends between the jaws 30, 31 and casing wall as well as through the nozzle 33.

The insert 33 serves to further smooth the flow of air within the projectile for passage out of the orifices 36.

Referring to FIG. 7, the projectile may also be provided with an insert in the form of a nozzle 42 having a single entry duct 43 and a pair of exit ducts 44, 45. As indicated, the nozzle 42 is disposed behind the clamping jaws 40 of a yarn clamp 41 while the exit ducts 44, 45 are shaped to be in direct communication or registery with exit orifices 46, 47 in the opposed walls 48 of the casing of the projectile.

As further indicated in FIG. 7, the projectile cooperates with a weft yarn insertion device 49 through which a weft yarn 50 is delivered. As indicated, when the yarn clamp is opened, the weft yarn end 50' is guided between the jaws 40 while air is exhausted directly through the exit orifices 46, 47. Thereafter, the clamp 41 closes.

Since the air which enters into the projectile leaves directly via the exit ducts 44, 45 and the orifices 46, 47, fluff which might impair satisfactory operation of the yarn clamp cannot be deposited in the casing.

Referring to FIGS. 8 and 9, the projectile may also be provided with an integral nozzle. As indicated in FIG. 9, the nozzle 55 is formed by a local deformation of a pair of opposed casing walls 56 behing the clamping jaws 59. To this end, each wall 56 is cut through on both sides along the lines a, b. In addition, the portion of the casing between the lines a, b is cut through in a transverse direction. The resulting lips 57, 58 on the opposite sides of the casing are then inwardly deformed to form the nozzle 55. Lips 60, 61 which are formed on the other side of the transverse cut are also inwardly deformed in opposed relation downstream on the nozzle 55 in order to bound a pair of opposed orifices 63, 64 while closing the space behind them.

Referring to FIGS. 10 and 11, a yarn clamp 70 for a projectile may have two arms 71, 72 which are formed with stepped clamping jaws 73, 74 so that the jaws partly overlap. As indicated, one jaw 73 has a first step 75 and a following second step 76 while the opposite jaw 74 has a first step 77 and a second step 78. The first steps 75, 77 extend parallel when the clamp is in the closed position. Similarly, the second step 76, 78 extend in parallel when the clamp is closed.

The steps 76, 78 form the actual clamping surfaces 76', 78' of the clamp while the first step 75 of the jaw 73 is provided with a funnel-shaped centering duct for passage of a weft yarn 80. As indicated in FIG. 11, this duct 79 terminates before the steps 76, 78.

During operation, a weft yarn 80 can be delivered through a weft yarn supplying device 81 to an extent so that an end 80' of the weft yarn passes through the centering duct 79 and, hence, between the clamping surfaces 76', 78'.

Referring to FIG. 12, a yarn clamp 87 can be provided with a pair of clamping jaws 85, 86 which are each provided with a centering duct 88, 89. In this case, each centering duct 88, 89 has an outlet 90 which terminates in a respective clamping surfaces 85', 86' and faces the opposite jaw 85, 86. As indicated, a weft yarn end 93' which is blown in by a weft yarn supplying device 92 reaches the clamping surface 85' through the outlet 90 of the centering duct 88. The other centering duct 89 is used for the next pick since the projectile would be turned through a semi-circle about a longitudinal axis during circulation through the weaving machine.

Referring to FIG. 13, wherein like reference characters indicate like parts as above, for a double pick, the two centering ducts 88, 89 of the jaws 85, 86 are used simultaneously. In this case, the projectile cooperates with two weft yarn insertion devices 95, 96 each of which supplies a respective weft yarn 97, 98 either simultaneously or in correspondence with a special patterning program. As indicated, the two yarn ends 97', 98' of the weft yarns are engaged and clamped simultaneously by the closing jaws 85, 86.

Referring to FIGS. 14 and 15, a projectile 105 may be provided with a yarn clamp 106 which terminates within the projectile casing upstream of a centering insert 107. As indicated, the yarn clamp 106 has a pair of clamping jaws 112, 113 for clamping the end 114' of a delivered weft yarn 114. The centering insert 107 has a weft yarn entry chamber 108 which extends in funnel-fashion towards the jaws 112, 113 with an exit orifice 111 disposed centrally of the jaws 112, 113.

This projectile 105 cooperates with a weft yarn supplying device 110 for delivering one or more of a number of weft yarns. This insertion device 110 retains all the weft yarns until one is required to be picked in accordance with a given pattern. In this event, the weft yarn end concerned, for instance, end 114' of the weft yarn 114 is delivered through an entry 108' of the entry chamber 108 of the insert 107. To this end, the entry 108' has dimensions corresponding to those of the exit 109 (see FIG. 14) of the yarn supplying device 110. After passage through the insert 107, the yarn end 114' is disposed between the jaws 112, 113 for subsequent clamping.

The invention thus provides a gripper clamp projectile which is able to receive an air entrained weft yarn in a smooth reliable manner while exhausting the entraining air in a relatively simple manner. The projectile permits the air which is injected by a yarn supplying device and entraining a weft yarn end to flow through without turbulance while the weft yarn end arrives between the clamping jaws of the projectile in a stretched condition.

What is claimed is:

1. A gripper clamp projectile for a weaving machine comprising a casing having a pair of opposed walls at least one of said walls having an orifice therein; and a yarn clamp disposed in said casing and having a pair of axially extending arms, each said arm having a clamping jaw at one end thereof, said arms being movable between a closed position with said clamping jaws in engagement and an open position with said clamping jaws spaced from each other and defining an air flow duct with said casing walls in communication with said orifice to conduct a flow of air therethrough.

2. A gripper clamp as set forth in claim 1 wherein each clamping jaw includes a recess facing the other jaw to define a conical centering aperture with the recess in said other jaw in said closed position.

3. A gripper clamp as set forth in claim 1 which further comprises an insert in said casing defining a nozzle between and in communication with said duct and said orifice.

4. A gripper clamp as set forth in claim 3 wherein said casing has an orifice in each of said walls and said nozzle defines a pair of exit ducts, each said exit duct being disposed in direct communication with a respective orifice.

5. A gripper clamp as set forth in claim 1 wherein said casing walls are deformed inwardly to define a nozzle behind said clamping jaws and include a pair of inwardly deformed lips in opposed relation downstream of said nozzle to bound a pair of opposed orifices.

6. A gripper clamp as set forth in claim 1 wherein said clamping jaw has a pair of steps, a first of said steps facing a first step of the other jaw and a second of said steps facing a second step of said other jaw, and a centering duct in one of said first steps for receiving a weft yarn.

7. A gripper clamp as set forth in claim 1 wherein each of said clamping jaws has a centering duct therein to receive a weft yarn, each said duct having an outlet facing the other of said jaws.

8. A gripper clamp as set forth in claim 1 which further comprises a centering insert in said casing, said insert having a weft yarn entry chamber extending in funnel-fashion towards said jaws with an exit orifice disposed centrally of said jaws.

9. A gripper clamp as set forth in claim 1 which further comprises a centering insert in said casing, said insert hving a weft yarn entry chamber extending in funnel-fashion towards said jaws with an exit orifice disposed centrally of said jaws.

10. A gripper clamp projectile for a weaving machine comprising a casing having walls with at least on air exhaust orifice in at least one wall thereof; and a yarn clamp having a pair of clamping jaws disposed in said casing for movement between a closed position to clamp a weft yarn therebetween and an open position with said clamping jaws spaced from each other and defining an air flow duct with said casing walls in communication with said orifice to conduct a flow of air therethrough.

11. A gripper clamp as set forth in claim 10 wherein each clamping jaw includes a recess facing the other jaw to define a conical centering aperture with the recess in said other jaw in said closed position.

12. A gripper clamp as set forth in claim 10 which further comprises an insert in said casing defining a nozzle between and in communication with said duct and said orifice to guide a flow of air therethrough.

13. A gripper clamp as set forth in claim 10 wherein said casing has an orifice in two opposed walls and which further comprises an insert in said casing with an entry duct facing said clamping jaws and a pair of exit ducts each in direct communication with a respective orifice.

14. A gripper clamp as set forth in claim 10 wherein said casing has a pair of opposed inwardly deformed walls defining a nozzle behind said jaws and a pair of inwardly deformed lips in opposed relation downsteam of said nozzle to bound a pair of opposed orifices in communication with said nozzle.

15. A gripper clamp as set forth in claim 10 wherein at least one jaw has a centering duct for passage of a weft yarn.

16. A gripper clamp as set forth in claim 15 wherein each jaw has a centering duct and wherein each duct has an outlet facing the other jaw.

17. A gripper clamp as set forth in claim 15 wherein said jaws are stepped and disposed in overlapping relation.

18. In combination, a weft supplying device having a duct for conveying a weft yarn therethrough, said duct having a predetermined diameter (d); and a gripper clamp projectile for receiving a weft yarn from said supplying device, said projectile including a casing having a pair of opposed walls and an orifice in at least one wall, and a yarn clamp disposed in said casing with a pair of axially extending arms, each arm having a clamping jaw with a clamping surface of a height at least twice the diameter (d) of said duct, said arms being movable to an open position with said jaws spaced from each other to define an air duct with said casing walls in communication with said orifice to conduct a flow of air therethrough.

* * * * *

UNITED STATES PATENT AND TRADEMARK OFFICE

CERTIFICATE OF CORRECTION

PATENT NO. : 4,491,158

DATED : January 1, 1985

INVENTOR(S) : Paul Lincke

It is certified that error appears in the above-identified patent and that said Letters Patent is hereby corrected as shown below:

Column 6, line 23 change "claim 1" to -claim 10-

Signed and Sealed this

*First* Day of *October 1985*

[SEAL]

*Attest:*

DONALD J. QUIGG

*Attesting Officer*

*Commissioner of Patents and Trademarks—Designate*